US006527272B1

(12) United States Patent
Conner

(10) Patent No.: US 6,527,272 B1
(45) Date of Patent: Mar. 4, 2003

(54) MULTIPLE PATH GAME BOARD

(76) Inventor: William L. Conner, 8061 Hunterbrook La., Fulton, MD (US) 20759

( * ) Notice: Subject to any disclaimer, the term of this patent is extended or adjusted under 35 U.S.C. 154(b) by 0 days.

(21) Appl. No.: 09/881,966

(22) Filed: Jun. 15, 2001

(51) Int. Cl.[7] ..... A63F 3/00
(52) U.S. Cl. ..... 273/243; 273/262
(58) Field of Search ..... 273/236, 243, 273/248, 258, 260, 261–262, 255

(56) References Cited

U.S. PATENT DOCUMENTS

| | | | | | |
|---|---|---|---|---|---|
| 3,759,521 | A | | 9/1973 | Breslow et al. | |
| 4,046,381 | A | | 9/1977 | Comeaux | |
| D246,265 | S | | 11/1977 | Wood | |
| 4,244,579 | A | | 1/1981 | Campos | |
| 4,273,337 | A | * | 6/1981 | Carrera et al. | 273/243 |
| 4,368,889 | A | * | 1/1983 | Reker, Jr. | 273/243 |
| 4,940,235 | A | | 7/1990 | Martin | |
| 5,273,431 | A | * | 12/1993 | Charouhas | 273/243 |
| 5,403,012 | A | * | 4/1995 | Stein | 273/261 |
| D367,499 | S | | 2/1996 | Evans et al. | |
| 5,758,877 | A | * | 6/1998 | Liddell | 273/249 |

* cited by examiner

*Primary Examiner*—Benjamin H. Layno
*Assistant Examiner*—V K Mendiratta

(57) ABSTRACT

A multiple level board game for providing a challenging game for people of all ages. The multiple level board game includes a game board having a top side and a plurality of game-piece movement sections displayed upon the top side thereof and a plurality of deck placement sections also being displayed upon the topside thereof; and also includes a plurality of multi-level game-pieces for moving upon the game-piece movement sections; and further includes decks of cards each determining movement of the game-pieces and each being used for a particular player level of the multiple level board game; and also includes pairs of dice each being used for a particular player level of the multiple level board game.

1 Claim, 4 Drawing Sheets

MULTIPLE PATH GAME BOARD

BACKGROUND OF THE INVENTION

1. Field of the Invention

The present invention relates to a board game with decks of cards and more particularly pertains to a new multiple level board game for providing a challenging game for people of all ages.

2. Description of the Prior Art

The use of a board game with decks of cards is known in the prior art. More specifically, a board game with decks of cards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,940,235; U.S. Pat. No. 4,046,381; U.S. Pat. No. 4,244,579; U.S. Pat. No. 3,759,521; U.S. Pat. No. Des. 367,499; and U.S. Pat. No. Des. 246,265.

While these devices fulfill their respective, particular objectives and requirements, the aforementioned patents do not disclose a new multiple level board game. The inventive device includes a game board having a top side and a plurality of game-piece movement sections displayed upon the top side thereof and a plurality of deck placement sections also being displayed upon the topside thereof; and also includes a plurality of multi-level game-pieces for moving upon the game-piece movement sections; and further includes decks of cards each determining movement of the game-pieces and each being used for a particular player level of the multiple level board game; and also includes pairs of dice each being used for a particular player level of the multiple level board game.

In these respects, the multiple level board game according to the present invention substantially departs from the conventional concepts and designs of the prior art, and in so doing provides an apparatus primarily developed for the purpose of providing a challenging game for people of all ages.

SUMMARY OF THE INVENTION

In view of the foregoing disadvantages inherent in the known types of board game with decks of cards now present in the prior art, the present invention provides a new multiple level board game construction wherein the same can be utilized for providing a challenging game for people of all ages.

The general purpose of the present invention, which will be described subsequently in greater detail, is to provide a new multiple level board game which has many of the advantages of the board game with decks of cards mentioned heretofore and many novel features that result in a new multiple level board game which is not anticipated, rendered obvious, suggested, or even implied by any of the prior art board game with decks of cards, either alone or in any combination thereof.

To attain this, the present invention generally comprises a game board having a top side and a plurality of game-piece movement sections displayed upon the top side thereof and a plurality of deck placement sections also being displayed upon the topside thereof; and also includes a plurality of multi-level game-pieces for moving upon the game-piece movement sections; and further includes decks of cards each determining movement of the game-pieces and each being used for a particular player level of the multiple level board game; and also includes pairs of dice each being used for a particular player level of the multiple level board game.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple level board game which has many of the advantages of the board game with decks of cards mentioned heretofore and many novel features that result in a new multiple level board game which is not anticipated, rendered obvious, suggested, or even implied by any of the prior art board game with decks of cards, either alone or in any combination thereof.

It is another object of the present invention to provide a new multiple level board game which may be easily and efficiently manufactured and marketed.

It is a further object of the present invention to provide a new multiple level board game which is of a durable and reliable construction.

An even further object of the present invention is to provide a new multiple level board game which is susceptible of a low cost of manufacture with regard to both materials and labor, and which accordingly is then susceptible of low prices of sale to the consuming public, thereby making such multiple level board game economically available to the buying public.

Still yet another object of the present invention is to provide a new multiple level board game which provides in the apparatuses and methods of the prior art some of the advantages thereof, while simultaneously overcoming some of the disadvantages normally associated therewith.

Still another object of the present invention is to provide a new multiple level board game for providing a challenging game for people of all ages.

Yet another object of the present invention is to provide a new multiple level board game which includes a game board having a top side and a plurality of game-piece movement sections displayed upon the top side thereof and a plurality of deck placement sections also being displayed upon the topside thereof; and also includes a plurality of multi-level game-pieces for moving upon the game-piece movement sections; and further includes decks of cards each determining movement of the game-pieces and each being used for a particular player level of the multiple level board game; and also includes pairs of dice each being used for a particular player level of the multiple level board game.

Still yet another object of the present invention is to provide a new multiple level board game that is entertaining and relies not on skill by on luck.

Even still another object of the present invention is to provide a new multiple level board game that keeps all players in suspense right up to the end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
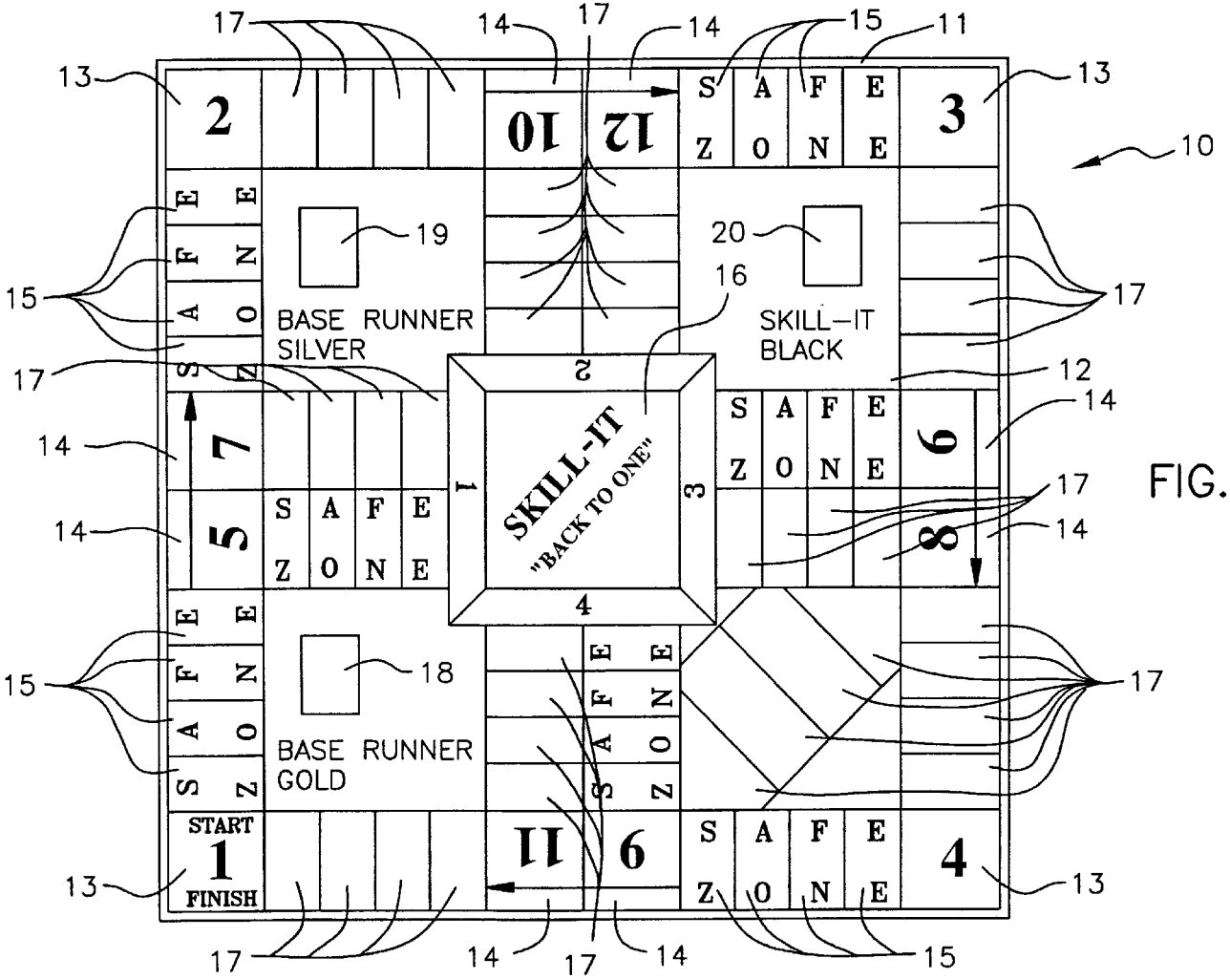
FIG. 1 is a top plan view of a new multiple level board game according to the present invention.
Figure 2:
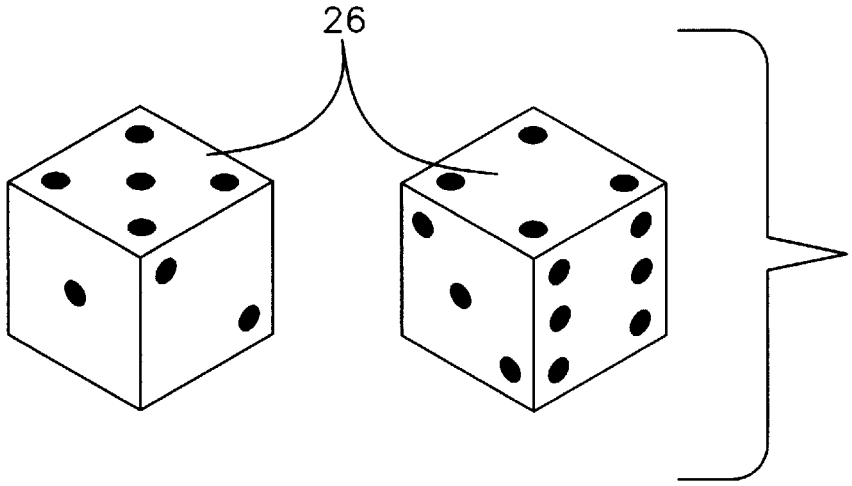
FIG. 2 is a perspective view of the game beginning dice the present invention.
Figure 3:
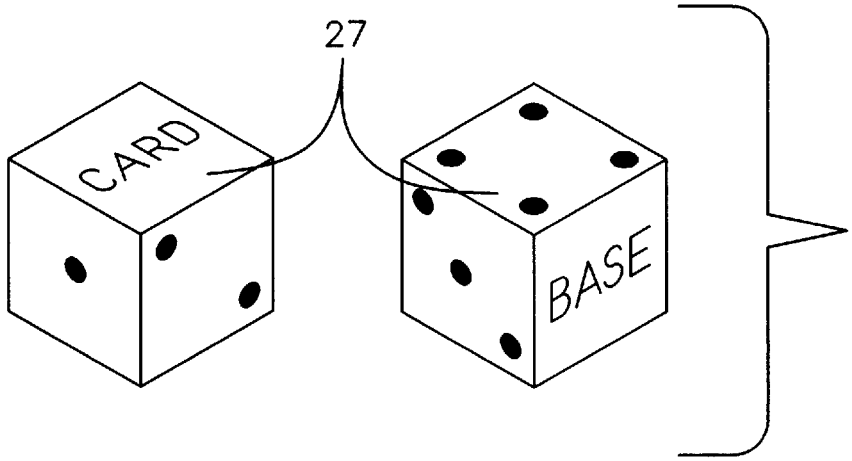
FIG. 3 is a perspective view of the base runner dice of the present invention.
Figure 4:
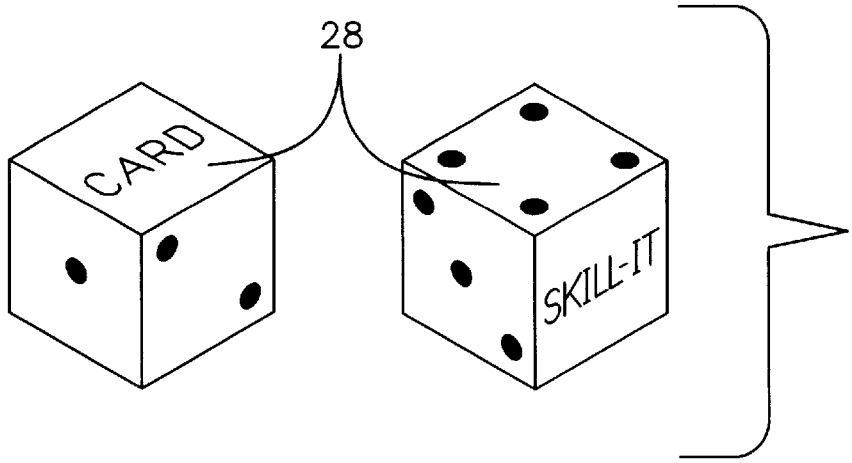
FIG. 4 is a perspective view of the skill-it level dice of the present invention.
Figure 5:
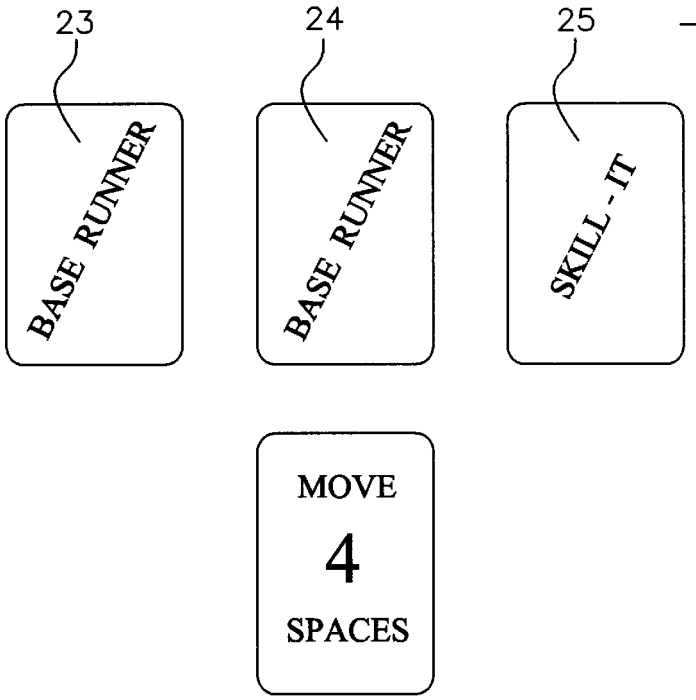
FIG. 5 is a top plan view of the decks of cards of the present invention.
Figure 6:
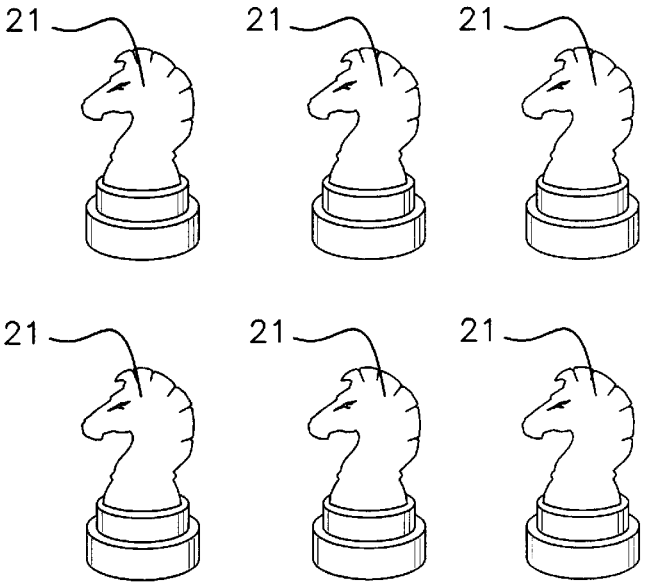
FIG. 6 is a perspective view of the skill-it game pieces of the present invention.
Figure 7:
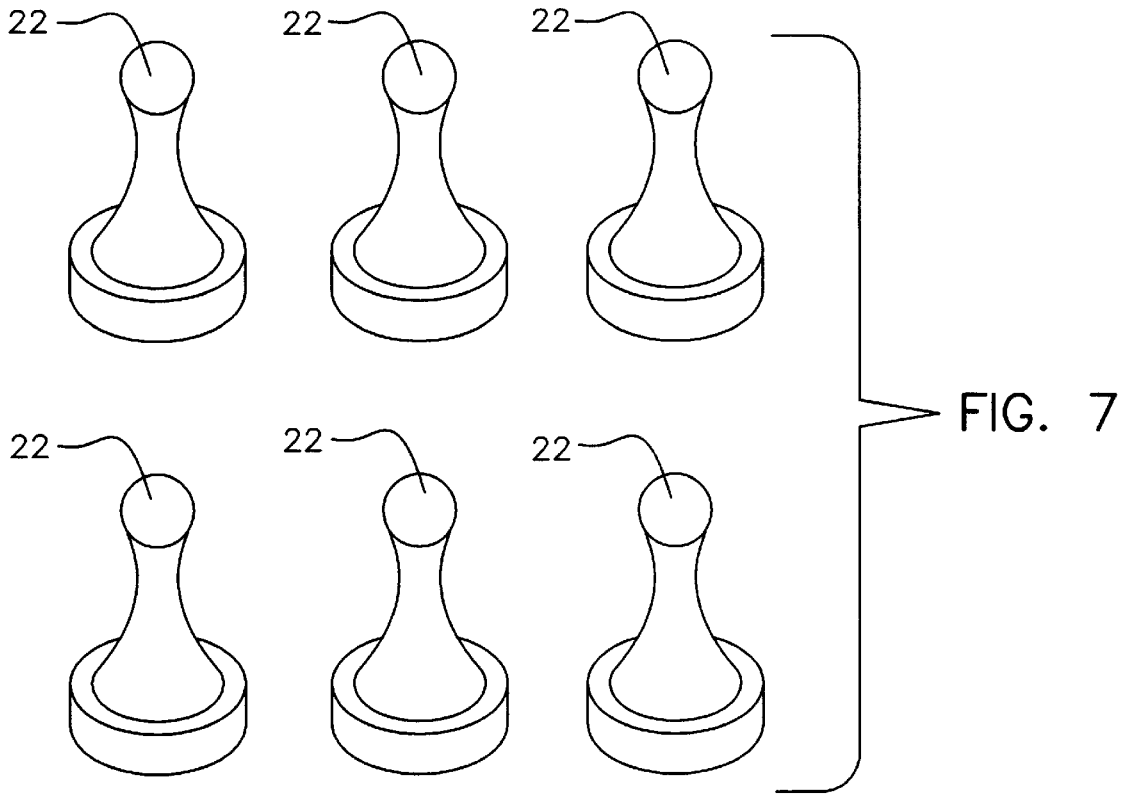
FIG. 7 is a perspective view of the base-runner game pieces of the present invention.

With reference now to the drawings, and in particular to FIGS. 1 through 7 thereof, a new multiple level board game embodying the principles and concepts of the present invention and generally designated by the reference numeral 10 will be described.

As best illustrated in FIGS. 1 through 7, the multiple path board game 10 generally comprises a game board 11 having a top side 12 and a plurality to game-piece movement sections 13–17 conventionally displayed upon the top side 12 thereof and a plurality of deck placement sections 18–20 also being conventionally displayed upon the topside 12 thereof. The game-piece movement sections 13–17 include a plurality of base movement sections 13, 14 being displayed in corners of the game board 11 and also being disposed along sides of the game board 11 intermediate of the corners. The base movement sections 13, 14 include four corner base movement sections 13 and eight intermediate base movement sections 14. The base movement sections 13, 14 are numbered consecutively from "1" to "12". The game-piece movement sections 13–17 also include a skill-it movement section 16 being centrally and conventionally displayed upon the top side 12 of the game board 11. The game-piece movement sections 13–17 further include a plurality of safety-zone movement sections 15 being conventionally displayed along the perimeter of the game board 11 between the intermediate base movement sections 14 and the corner base movement sections 13 and also being conventionally displayed between the intermediate base movement sections 14 and the skill-it movement section 16. The game-piece movement sections 13–17 also include a plurality of plain movement sections 17 being conventionally displayed along the perimeter of the game board 11 between the intermediate base movement sections 14 and the corner base movement sections 13 and also being conventionally displayed between the intermediate base movement sections 14 and the skill-it movement section 16. The game-piece movement sections 13–17 are colored and may be black, blue, orange, red, and yellow. The top side 12 of the game board 11 has words "SKILL-IT", "SAFE ZONE", "BASE RUNNER GOLD", "BASE RUNNER SILVER", and "SKILL-IT BLACK" conventionally displayed thereupon.

A plurality of game pieces 21, 22 are provided for moving upon the game-piece movement sections 13–17, and the plurality game pieces includes pawn-shaped game pieces 22 for base-runner level or status players moving forwardly along the spaces of the base movement section and also includes knight-shaped game pieces 21 for skill-it level or status players moving backwardly along the spaces of the skill-it and base movement sections.

Decks of cards 23–25 are provided for determining movement of the game pieces 21, 22, and each deck is used for a particular player level of the multiple path board game 10. The decks of cards include a gold base-runner deck of cards 23 and a silver base-runner deck of cards 24, both of which are adapted to be used by base-runner level or status players to determine movement of the pawn-shaped game pieces 22. The decks of cards further include a black deck of cards 25 which are adapted to be used by skill-it status players to determine movement of the knight-shaped game-pieces 21.

Pairs of die 26–28 are each used for a particular or path of the multiple path board game 10. The pairs of die 26–28 include a first pair of die 26 with each die having six sides and having up to six dots displayed upon the sides. The first pair of die 26 is used to determine which player is to begin the multiple path board game 10. The pairs of die 26–28 also include a second pair of die 27 with each die having six sides and each side having up to four dots or the word "card" or the word "base" displayed upon the sides. The second pair of die 27 is used to either allow the player to move one's game piece 22 to a particular game-piece movement section 13–17 or allow the player to select a card from either of the silver base-runner deck of cards 24 or the gold base-runner deck of cards 23. The pairs of die 26–28 further include a third pair of die 28, with each die of the third pair having six sides and having up to four dots or the word "card" or the word "skill-it" displayed upon the sides. The third pair of dice 28 is used to allow the player to move one's game-piece in the skill-it movement section 16 and allow the player to select a card from the black deck of cards 25.

In use, the players roll the first pair of die 26 to determine sequence of play among the players. Each player begins the game at the base runner level, or base runner status, and each player rolls the second pair of die 27 to determine the movement of his or her pawn-shaped game piece 22 along the path comprising the game-piece movement sections 13–17 until the player's game piece reaches the skill-it movement section 16. Upon reaching the skill-it movement section 16, the player's level, or status in the game, changes and the player's pawn-shaped game piece 22 is converted to a knight-shaped game piece 21, and the player then rolls the third pair of die 28 to determine the movement of his or her knight-shaped game piece 22 along the path comprising the skill-it movement section 16. Once a player has achieved skill-it status in the game, and the player's pawn-shaped game piece 22 becomes a knight-shaped game piece 21, the game piece is moved backwards through the skill-it movement section 16 using the second pair of dice 27 and the gold or silver base-runner decks of cards 23, 24. The players keep rolling the second pair of die 27 to determine movement of the knight-shaped game pieces 21 upon the base movement sections 13, 14 (in the backward direction), and moves the knight-shaped game pieces 21 upon the game-piece movement sections 13–17 until other game-pieces 21, 22 are eliminated or until one of the knight-shaped game-pieces 21 is moved to the "1" base movement section 14.

When rolling the second pair of die 27, the player of base runner status picks a card from either of the gold or silver base-runner deck of cards 23, 24 if either of the second pair of die 27 lands with the word "CARD" upward to thereby determine movement of the player's pawn-shaped game-piece 22. When rolling the third pair of die 28, the player of skill-it status picks up a card from the black deck of cards 25 if either of the third pair of die 28 lands with the word "CARD" upward to determine movement of the player's knight-shaped game piece 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple path board game comprising:

a game board having a top side and a plurality of game-piece movement sections displayed upon said top side thereof and a plurality of deck placement sections also being displayed upon said topside thereof, said game-piece movement sections defining a pair of paths including a continuous base movement path and a continuous skill-it movement path inside of said base movement path, said base movement path and said skill it movement path being linked to permit movement therebetween;

a plurality of game pieces for moving upon said game-piece movement sections;

decks of cards each determining movement of said game pieces and each being used for a particular player status; and pairs of die each being used for a particular said player status;

wherein the base movement path of said game-piece movement sections includes a plurality of base movement sections being disposed in corners of said game board and also being disposed along sides of said game board intermediate of said corners, said base movement sections including four corner base movement sections and eight intermediate base movement sections, said base movement sections being numbered consecutively from "1" to "12";

wherein the skill-it movement path of said game-piece movement sections includes a skill-it movement section being centrally disposed upon said top side of said game board;

wherein the base movement path of said game-piece movement sections further include a plurality of safety-zone movement sections being disposed along said perimeter of said game board between said intermediate base movement sections and said corner base movement sections and also being disposed between said intermediate base movement sections and said skill-it movement section;

wherein the base movement path of said game-piece movement sections also include a plurality of plain movement sections being disposed along said perimeter of said game board between said intermediate base movement sections and said corner base movement sections and also being disposed between said intermediate base movement sections and said skill-it movement section;

wherein said game-piece movement sections are colored which includes black, blue, orange, red, and yellow, said top side of said game board having words "SKILL-IT", "SAFE ZONE", "BASE RUNNER GOLD", "BASE RUNNER SILVER", and "SKILL-IT BLACK" displayed thereupon;

wherein said game pieces include pawn-shaped game pieces for base-runner players and also include knight-shaped game pieces for skill-it players;

wherein said decks of cards include a gold base-runner deck of cards and a silver base-runner deck of cards both for use by base-runner players to determine movement of said game pieces, and further include a black deck of cards for use by skill-it players to determine movement of said game-pieces;

wherein said pairs of die include a first pair of die with each die having six sides and having up to six dots displayed upon said sides, said first pair of die being usable for determining which player is to begin said multiple level board game;

wherein said pairs of die also include a second set of die with each die having six sides and having up to four dots and the words "card" and "base" displayed upon said sides of said die, said second pair of die being usable for determining a player's movement of the player's said game piece to a particular said game-piece movement section or for directing the player to select a card from either of said silver base-runner deck of cards or said gold base-runner deck of cards when said word "card" is rolled on one of said die;

wherein said pairs of die further includes a third set of die with each die having six sides and having up to four dots and the words "card" and "skill-it" displayed upon said sides, said third pair of die being usable for determining movement of the player's said game piece out of said skill-it movement section and to said "12" base movement section or for directing the player to select a card from said black deck of cards.

* * * * *